US007134936B2

(12) United States Patent
Gariglio

(10) Patent No.: US 7,134,936 B2
(45) Date of Patent: Nov. 14, 2006

(54) GRINDING HEAD FOR A GRINDING MACHINE FOR GLASS SLABS, AND MACHINE EQUIPPED WITH SUCH HEAD

(75) Inventor: Davide Gariglio, Piossasco (IT)

(73) Assignee: Forvet S.r.l., Volvera (IT)

( * ) Notice: Subject to any disclaimer, the term of this patent is extended or adjusted under 35 U.S.C. 154(b) by 275 days.

(21) Appl. No.: 10/820,201

(22) Filed: Apr. 6, 2004

(65) Prior Publication Data

US 2004/0209557 A1 Oct. 21, 2004

(30) Foreign Application Priority Data

Apr. 16, 2003 (IT) ..... TO2003A0297

(51) Int. Cl.
*B24B 49/00* (2006.01)
*B24B 9/08* (2006.01)
*B24B 7/00* (2006.01)

(52) U.S. Cl. ..... 451/11; 451/262; 451/278

(58) Field of Classification Search ..... 451/94, 451/207, 262, 278, 11, 194
See application file for complete search history.

(56) References Cited

U.S. PATENT DOCUMENTS 4,228,617 A * 10/1980 Bando ..... 451/5
4,375,738 A * 3/1983 Bando ..... 451/4
4,453,347 A * 6/1984 Redeker et al. ..... 451/247
5,816,897 A * 10/1998 Raeder et al. ..... 451/44
5,975,992 A * 11/1999 Raeder et al. ..... 451/44
6,231,429 B1 * 5/2001 Lisec ..... 451/44
6,325,704 B1 * 12/2001 Brown et al. ..... 451/44
6,629,875 B1 * 10/2003 Steere, III ..... 451/9
2002/0068514 A1 * 6/2002 Margaria ..... 451/44
2003/0092359 A1 * 5/2003 Pedrini ..... 451/5
2004/0209557 A1 * 10/2004 Gariglio ..... 451/44

* cited by examiner

*Primary Examiner*—M. Rachuba
(74) *Attorney, Agent, or Firm*—David A. Farah; Sheldon Mak Rose & Anderson PC

(57) ABSTRACT

A grinding machine (1) for glass slabs (2) comprising a grinding head (77) that comprises a supporting structure (9), grinding wheels (20, 28) for grinding and polishing the edge of the slab (2), and grinding wheels (24, 26) for grinding and polishing the threads of the slabs (2), where the grinding wheels (20, 28) for grinding and polishing the edges rotate independently one from another around an axis that is perpendicular to the rotation axis of the grinding wheels (24, 26) for grinding and polishing the threads, and where the grinding wheels (20, 24, 26, 28) for grinding and polishing the edges and polishing the threads are configured to perform, during operation, axial movements that can be actuated independently from each other along the slab (2).

34 Claims, 5 Drawing Sheets

GRINDING HEAD FOR A GRINDING MACHINE FOR GLASS SLABS, AND MACHINE EQUIPPED WITH SUCH HEAD

CROSS-REFERENCE TO RELATED APPLICATION

This application claims priority from Italian Patent Application TO2003A 000297 filed Apr. 16, 2003, the contents of which are incorporated by reference herein in their entirety.

BACKGROUND

During the manufacture of glass slabs, the edges of semi-finished glass slabs are generally ground on a grinding machine to produce the final shape of the slab. A grinding machine comprises a conveyor that moves the semi-finished glass slabs along a path through two working stations comprising a plurality of grinding wheels arranged in fixed positions along the path. The grinding wheels grind opposing edges on each slab. Sometimes, however, the semi-finished glass slabs are subjected to positioning and squaring errors with respect to the grinding wheels while the glass slabs are moved on the conveyor. These positioning and squaring errors can produce flaws in the finished edges of the glass slabs.

Therefore, there is a need for a grinding head for a glass slab grinding machine that reduces or eliminates the positioning and squaring errors of the semi-finished glass slabs with respect to grinding wheels while the semi-finished glass slabs are moved on a conveyor. Further, there is a need for a grinding machine that reduces or eliminates the positioning and squaring errors of the semi-finished glass slabs with respect to grinding wheels while the semi-finished glass slabs are moved on a conveyor. Additionally, there is a need for a method of grinding the edges of a glass slab that reduces or eliminates the positioning and squaring errors of the semi-finished glass slabs with respect to grinding wheels while the semi-finished glass slabs are moved on a conveyor.

SUMMARY

According to one embodiment, there is provided a grinding head for a grinding machine for grinding a glass slab having an edge and threads. The grinding head comprises a) at least one supporting structure; b) at least one first grinding wheel for grinding the edge of the slab, the first grinding wheel being supported and rotatingly driven by a first spindle, the first grinding wheel and the first spindle being contained in and supported by the supporting structure; c) at least one second grinding wheel for grinding the threads of the slab, the second grinding wheel being supported and rotatingly driven by a second spindle, the second grinding wheel and the second spindle being contained in and supported by the supporting structure; d) at least one third grinding wheel for polishing the edge of the slab, the third grinding wheel being supported and rotatingly driven by a third spindle, the third grinding wheel and the third spindle being contained in and supported by the supporting structure; and e) at least one fourth grinding wheel for polishing the threads of the slabs, the fourth grinding wheel being supported and rotatingly driven by a fourth spindle, the fourth grinding wheel and the fourth spindle being contained in and supported by the supporting structure; where the first and third grinding wheels for grinding and polishing the edges rotate, independently one from another, around an axis that is perpendicular to a rotation axis of the second and fourth grinding wheels for grinding and polishing the threads; where the first, second, third and fourth grinding wheels for grinding and polishing the edge and grinding and polishing the threads are configured to perform, during operation, axial movements along the slabs; and where the axial movements of the first, second, third and fourth grinding wheels are independently actuated one from another. In one embodiment, the grinding head comprises two first grinding wheels that are rotatingly driven by two respective first spindles.

According to another embodiment of the present invention, there is provided a grinding machine for grinding a glass slab comprising a grinding head of the present invention, and further comprising a chassis for supporting the grinding head. In one embodiment, the grinding head comprises four spindles that rotate around four respective axes, and configured to carry respective grinding wheels for grinding or polishing a section of the edge of the glass slab; where the grinding machine comprises means for connecting the spindles to the chassis; where the means for connecting comprises a supporting structure for the spindles and attaching and handling means carried by the supporting structure for coupling the supporting structure to the chassis in a movable way at least in a first advancement direction and configured to be motored in order to displace, during operation, the supporting structure with respect to the chassis along the section to be ground in the first advancement direction. In another embodiment, the attaching and handling means comprises a slide configured to cooperate with a guide carried by the chassis. In another embodiment, the attaching and handling means comprises a fifth wheel interposed between the supporting structure and the slide to allow a rotation of the supporting structure with respect to the slide around a hinge axis. In another embodiment, the fifth wheel axis is orthogonal to the first advancement direction. In another embodiment, at least one of the four axes is parallel to at least one other of the four axes. In another embodiment, at least one of the four axes is not parallel to at least one other of the four axes.

In one embodiment, the grinding machine further comprises a motor for each spindle for rotating the grinding wheel related to each spindle. In another embodiment, the grinding machine further comprises a motor for each spindle for axially advancing the grinding wheel related to each spindle. In another embodiment, the axes are orthogonal to a rectilinear direction that is parallel, during operation, to the section to be ground, an encumbrance occupied by the grinding wheels, measured along a rectilinear direction, being included between 25 and 35 centimeters. In another embodiment, at least part of the motors have respective elongated structures in orthogonal directions to a rectilinear direction. In one embodiment, the grinding head comprises two first spindles that are able to rotate around respective mutually parallel first axes lying in a plane, and two second spindles that form respective angles that are mutually equal and opposite with the plane. In another embodiment, the supporting structure is fork-shaped. In another embodiment, the supporting structure is further equipped with means for supporting the glass slab, and the means for supporting comprises a plurality of wheels to facilitate moving the slab. In another embodiment, the grinding wheel for grinding and polishing the threads and the grinding wheel for polishing the edge are driven by their respective spindles to create constant pressure by the grinding wheels on the glass slab during operation and to compensate for the consumption of the grinding wheels during their operation. In another embodiment, the spindles each comprise resilient means pre-loaded by a stepped motor that drives a ball screw for realizing the constant pressure on the glass slab during operation. In another embodiment, each of the spindles further comprises braking means that operates on sliding guides and block an advancement of the grinding wheels against the glass slabs between one slab and a following slab, to prevent the grinding wheels from penetrating into a hollow space between the two successive glass slabs during operation.

According to another embodiment of the present invention, there is provided a method of grinding the edges of a glass slab that reduces or eliminates positioning and squaring errors of semi-finished glass slabs with respect to grinding wheels while the semi-finished glass slabs are moved on a conveyor. The method comprises a) providing a grinding machine according to the present invention; and b) grinding the edges of the glass slab using the grinding machine.

FIGURES

These and other features, aspects and advantages of the present invention will become better understood with regard to the following description, appended claims, and accompanying figures where:

DESCRIPTION

Figure 1:
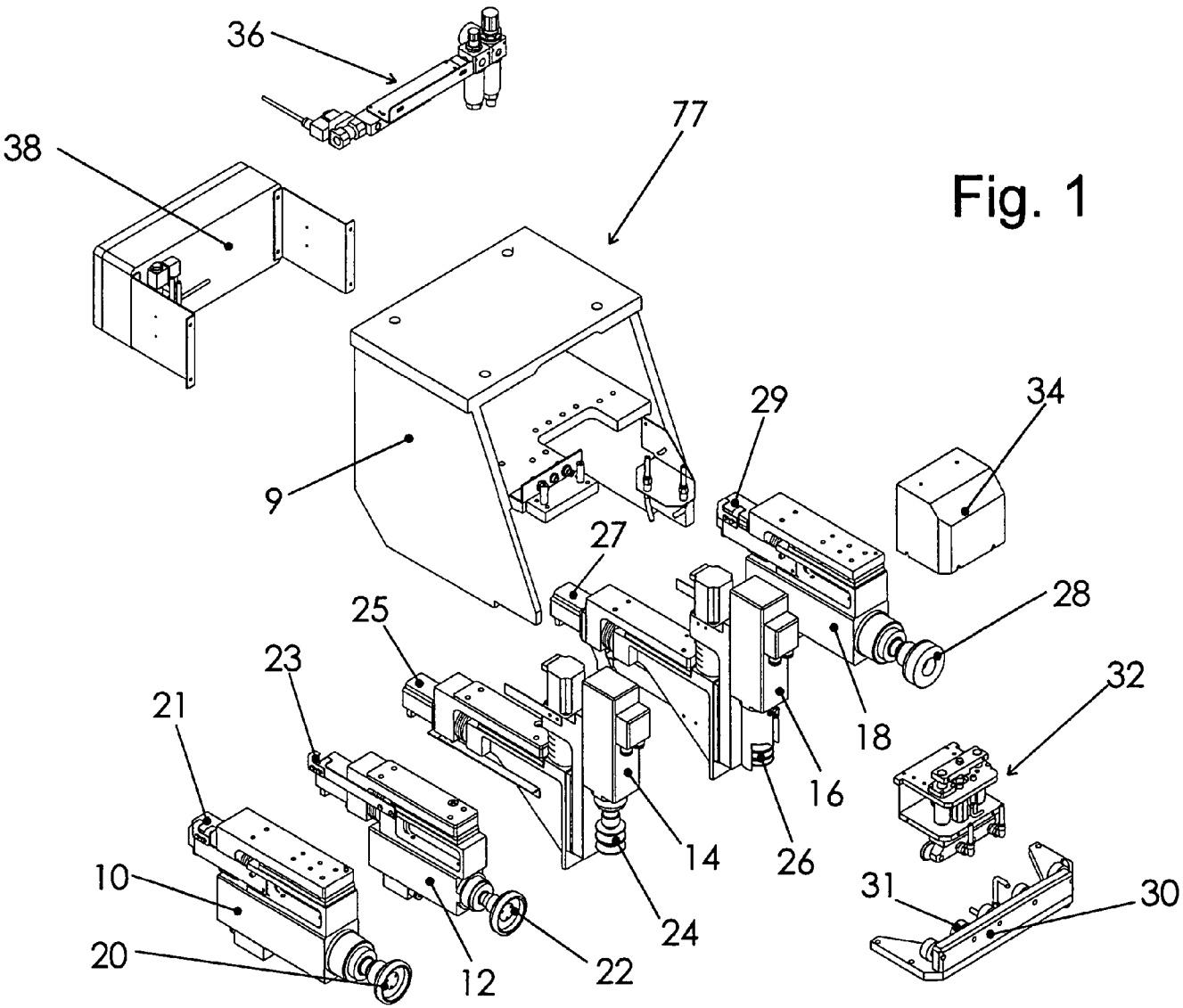
FIG. 1 is an exploded perspective view of a preferred embodiment of a grinding head according to the present invention.

According to one embodiment of the present invention, there is provided a grinding head for a glass slab grinding machine that reduces or eliminates positioning and squaring errors of the semi-finished glass slabs with respect to grinding wheels while the semi-finished glass slabs are moved on a conveyor. According to another embodiment of the present invention, there is provided a grinding machine that reduces or eliminates positioning and squaring errors of the semi-finished glass slabs with respect to grinding wheels while the semi-finished glass slabs are moved on a conveyor. In a preferred embodiment, the grinding machine comprises a grinding head according to the present invention. According to another embodiment of the present invention, there is provided a method of grinding the edges of a glass slab that reduces or eliminates positioning and squaring errors of the semi-finished glass slabs with respect to grinding wheels while the semi-finished glass slabs are moved on a conveyor. In a preferred embodiment, the method comprises providing a grinding machine according to the present invention. The devices and methods of the present invention will now be disclosed in greater detail.

The present invention includes a grinding machine for glass slabs comprising a grinding head that comprises a supporting structure, grinding wheels for grinding and polishing the edge of the slab, and grinding wheels for grinding and polishing the threads of the slabs, where the grinding wheels for grinding and polishing the edges rotate independently one from another around an axis that is perpendicular to the rotation axis of the grinding wheels for grinding and polishing the threads, and where the grinding wheels for grinding and polishing the edges and polishing the threads are configured to perform, during operation, axial movements, that can be actuated independently from each another along the slabs.

All dimensions specified in this disclosure are by way of example only and are not intended to be limiting. Further, the proportions shown in the accompanying Figures are not necessarily to scale. As will be understood by those with skill in the art with reference to this disclosure, the actual dimensions of any device or part of a device disclosed in this disclosure will be determined by their intended use.

In one embodiment, the present invention is a grinding head for a glass slab grinding machine that reduces or eliminates positioning and squaring errors of the semi-finished glass slabs with respect to grinding wheels while the semi-finished glass slabs are moved on a conveyor. The grinding head permits the accurate grinding of a glass slab in a working station by keeping the slab in a fixed univocal reference position when working an edge of the slab. In another embodiment, the present invention is a grinding head that can simultaneously grind a glass slab on two perpendicular sides independently, where the grinding can occur at different rates on the two sides.

Figure 3:
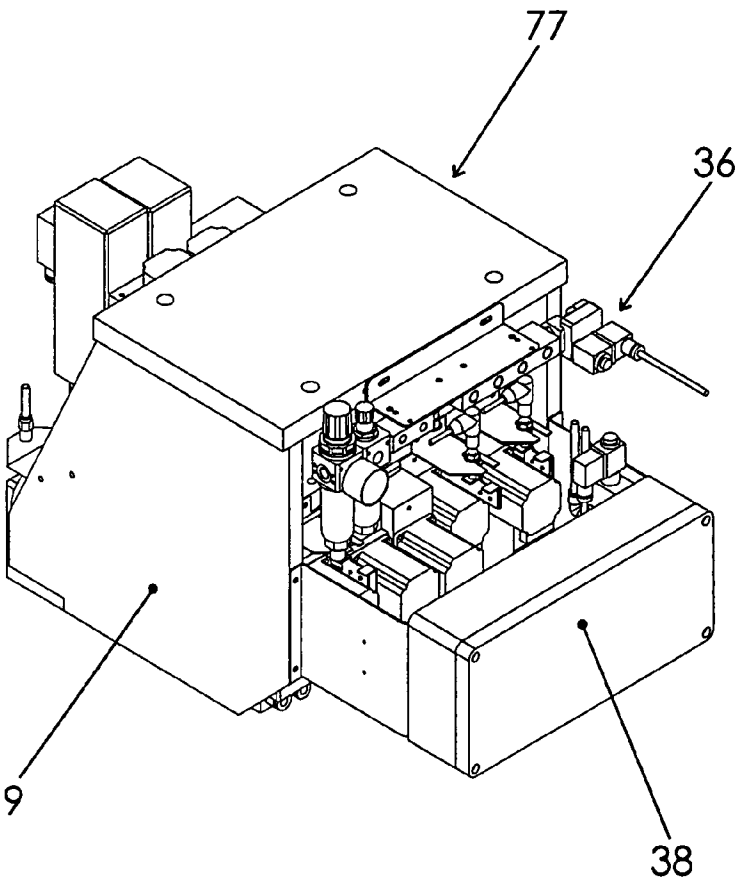
FIG. 3 is a back lateral perspective view of the grinding head shown in FIG. 2.
Figure 2:
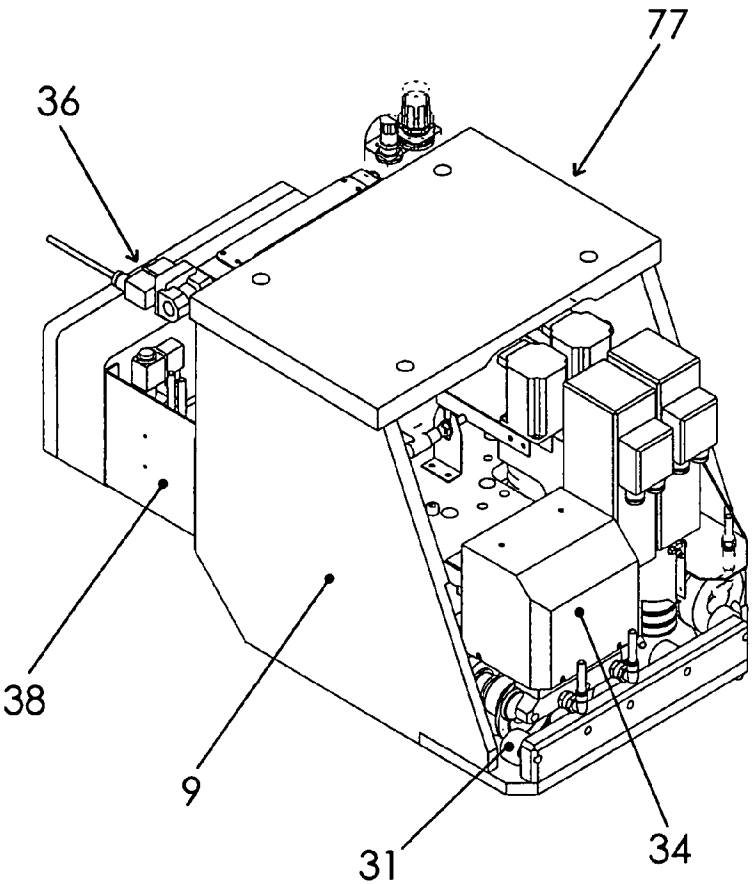
FIG. 2 is a front lateral perspective view of the assembled grinding head shown in FIG. 1.
Figure 4:
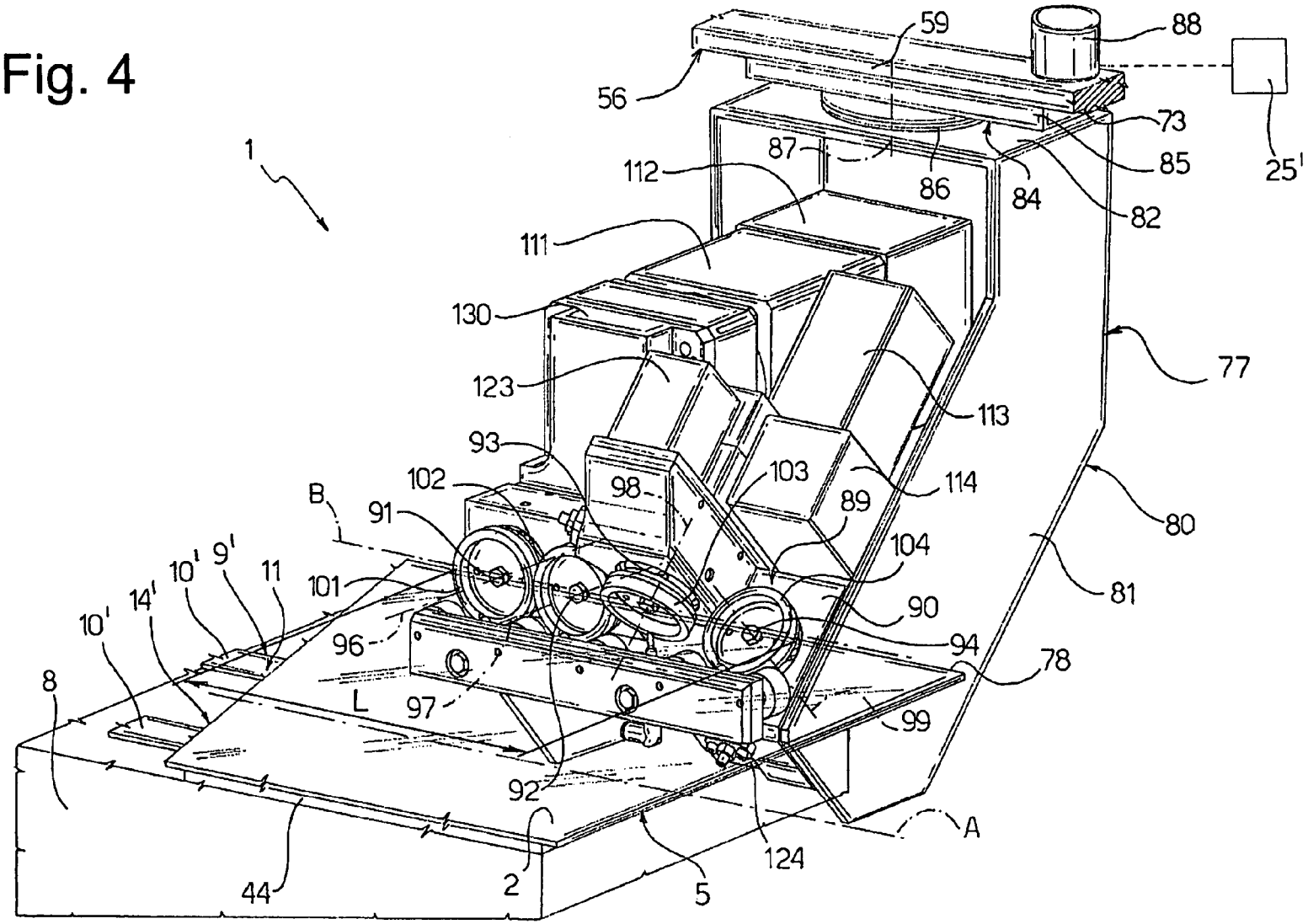
FIG. 4 is a front lateral perspective view of another preferred embodiment of a grinding head according to the present invention.
Figure 5:
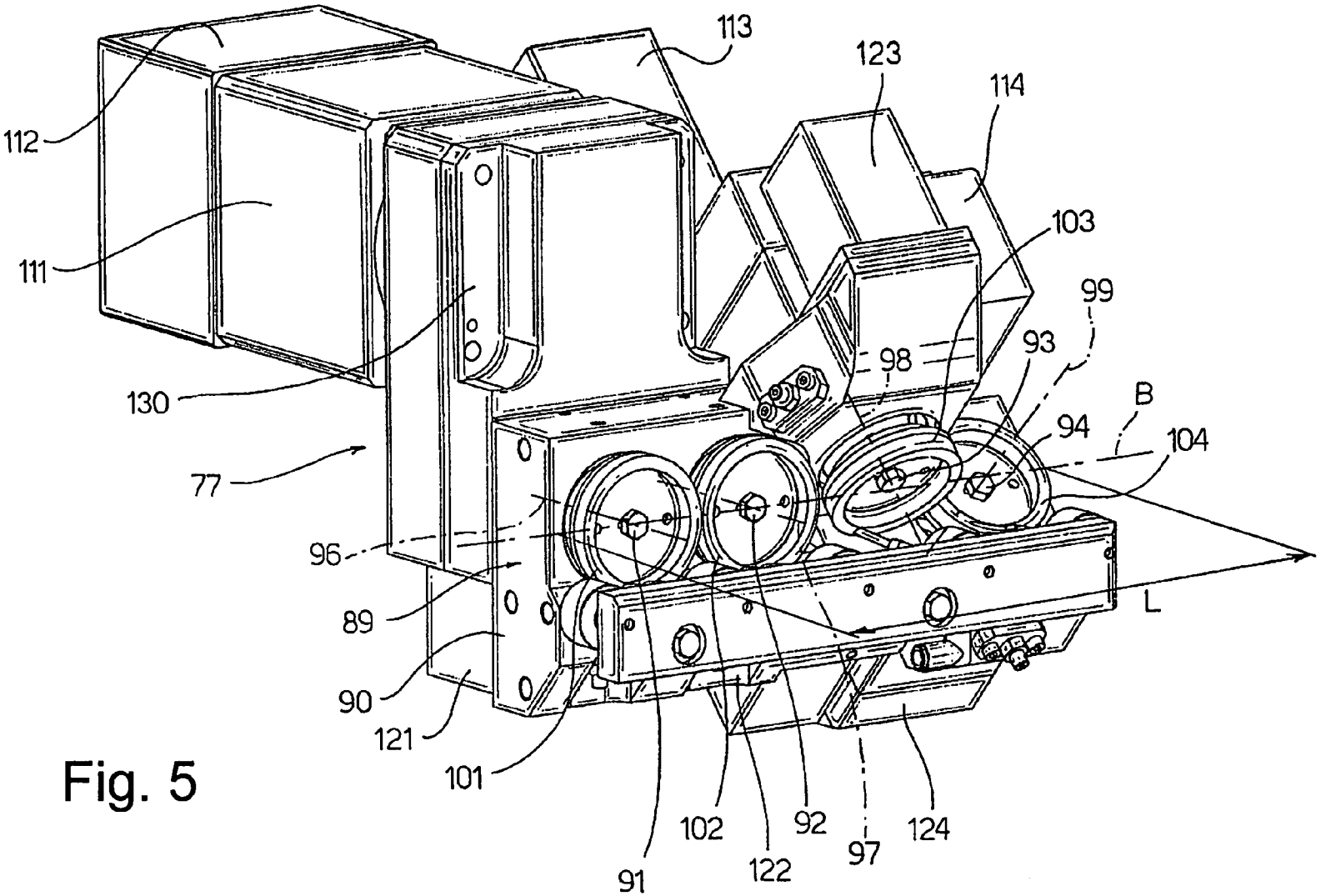
FIG. 5 is an enlarged, partial perspective view of the grinding head shown in FIG. 4 with some parts not shown.
Figure 6:
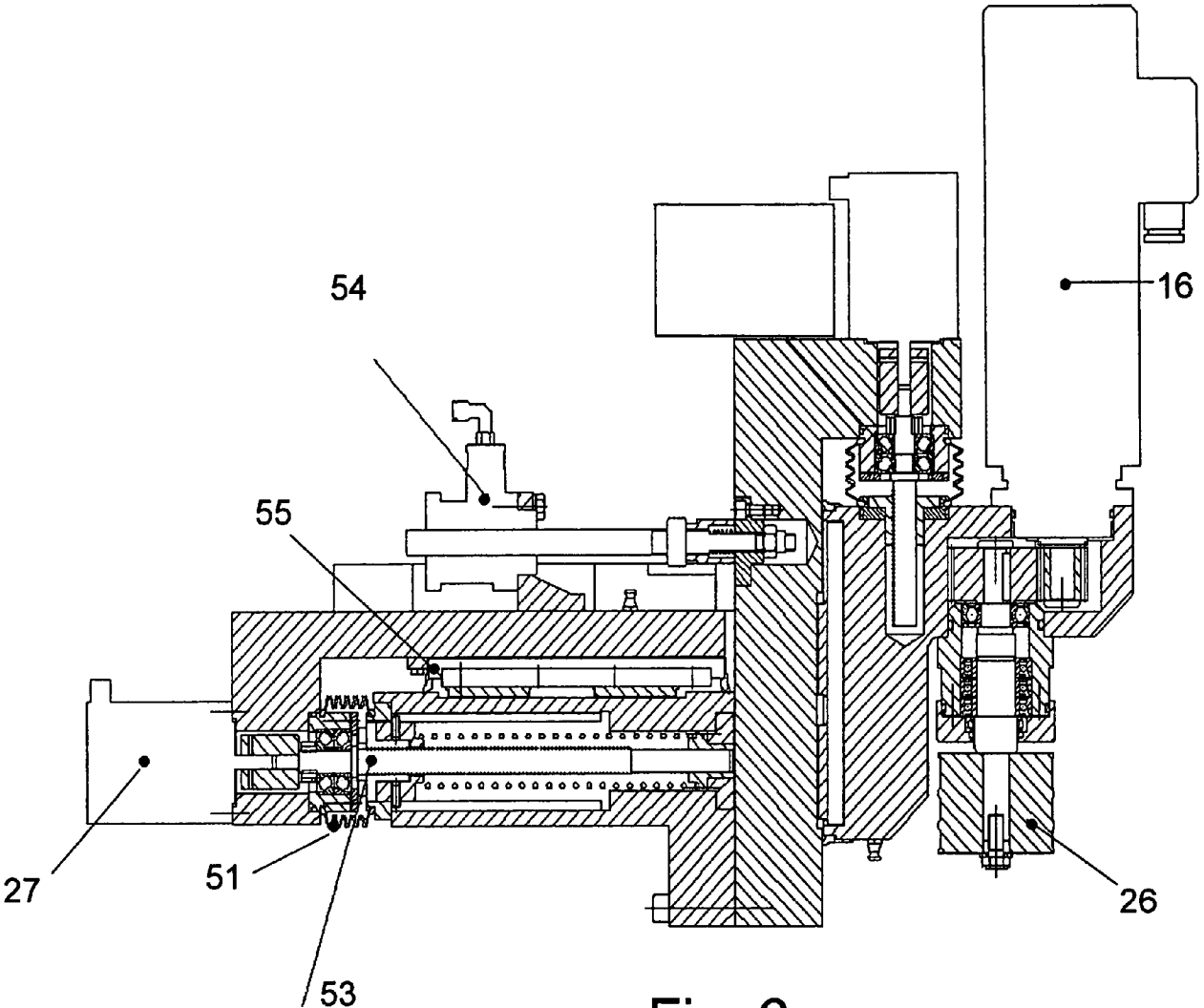
FIG. 6 is a lateral sectional view of a grinding wheel driving spindle.

Referring now to FIG. 1 to FIG. 6, there is shown respectively, an exploded perspective view of a preferred embodiment of a grinding head according to the present invention (FIG. 1); a front lateral perspective view of the assembled grinding head shown in FIG. 1 (FIG. 2); a back lateral perspective view of the grinding head shown in FIG. 2 (FIG. 3); a front lateral perspective view of another preferred embodiment of a grinding head according to the present invention (FIG. 4); an enlarged, partial perspective view of the grinding head shown in FIG. 4 with some parts not shown (FIG. 5); and a lateral sectional view of a grinding wheel driving spindle (FIG. 6). As can be seen, the grinding head 77 is configured to be incorporated into a grinding machine 1 for grinding glass slabs 2. The grinding head 77 allows a plurality of grinding and polishing operations to be performed on a fixed glass slab 2, driving grinding wheels and their respective spindles at mutually different speeds and placing the grinding wheels next to different parts of the slab 2 as needed to perform the relevant grinding and polishing operations.

The grinding head 77 comprises a supporting structure 9. The grinding head 77 further comprises at least one grinding wheel 20 for grinding the edges of a glass slab 2, where the grinding wheel 20 is supported and rotatingly driven by a spindle 10. The grinding head 77 further comprises at least one grinding wheel 24 for grinding the threads (or bevels) of the slab 2, where the grinding wheel 24 is supported and rotatingly driven by a spindle 14. The grinding head 77 further comprises at least one grinding wheel 28 for polishing the edge of the slab 2, where the grinding wheel 28 is supported and rotatingly driven by a spindle 18. The grinding head 77 further comprises at least one grinding wheel 26 for polishing the threads (or bevels) of the slab 2, where the grinding wheel 26 is supported and rotatingly driven by a spindle 16. The supporting structure 9 contains and supports the grinding wheel 20, the spindle 10, the grinding wheel 24, the spindle 14, the grinding wheel 28, the spindle 18, the grinding wheel 26 and the spindle 16.

The grinding wheels 20, 28 for grinding and polishing the edges rotate, independently one from another around an axis that is perpendicular to the rotation axis of the grinding wheels 24, 26 for grinding and polishing the threads through respective motors that actuate the various spindles 10, 14, 16, 18. Moreover, the grinding wheels 20, 22, 24, 26, 28 for grinding and polishing the edges, and grinding and polishing the threads are configured to move axially, while working, along the slab 2, where the axial movements of the grinding wheels 20, 22, 24, 26, 28 are independently actuated one from another.

In the preferred embodiment shown in FIG. 1 to FIG. 3, the grinding wheels for grinding the edges 20, 22 and are rotatingly driven by two respective spindles 10, 12. The grinding wheels 20, 22, 24, 26, 28 are further driven in their axial advancement by separate motors 21, 23, 25, 27, 29, respectfully, allowing for each grinding wheel 20, 22, 24, 26, 28 to be actuated independently from the others, therefore allowing the grinding wheels 20, 22, 24, 26, 28 to move and operate maximumly in all directions.

In a particularly preferred embodiment, the grinding wheel 26 for grinding and polishing the threads and the grinding wheel 28 for polishing the edges are driven by the respective spindles 16 and 18 which create constant pressure by the grinding wheels 26, 28 on the glass slab 2 when working and which compensate for the consumption of the grinding wheels 26, 28 during their operation. The constant pressure is created by the spindles 16, 18 which comprise resilient means 51, such as for example a spring, pre-loaded by a stepped motor 27 that drives a ball screw 53 pushed by the resilient means 51 to create the constant pressure on the glass slab 2.

Further, the spindles 16, 18 are each equipped with a braking means 54 that operates on sliding guides 55 and blocks the advancement of the grinding wheels 26, 28 against the glass slab 2 between one slab and a following slab, to prevent the grinding wheels 26, 28 from penetrating into the hollow space between the two successive glass slabs during operation. The braking means 54 unlocks the grinding wheels 26, 28 when they act on a glass slab 2 in a working position.

The supporting structure 9 further comprises a supporting means 30 for the glass slab 2, where the supporting means 30 comprises a plurality of small wheels 31 to facilitate advancement of the slab 2. The supporting structure 9 further comprises a control means 32 opposite to the grinding wheels 20, 22, 24, 26, 28, and joined through rear closing means 38.

Referring now to FIG. 4 and FIG. 5, there is shown a grinding machine 1 for glass slabs, such as the slab 2 which is partially shown. In a preferred embodiment, the grinding machine comprises a grinding head 77 according to the present invention. The glass slab 2 comprises an edge 5 to be ground having a generally rectangular shape. The grinding machine 1 comprises a basement 8 (partially shown), which carries a conveyor assembly 9' (partially shown) comprising, a plurality of dragging bands 10' to transfer the slab 2 on a horizontal plane 11 along a rectilinear horizontal longitudinal direction A starting from a loading station towards an unloading station through a working station 14'. The station 14 houses a positioning assembly (not shown) for arranging the slab 2 to be worked in a reference position on the plane 11, and a retention assembly 44 (schematically shown), such as a pneumatic assembly with suction cups, in order to keep the slab 2 in the reference position during grinding.

The grinding machine 1 further comprises a chassis 56 (partially shown), such as a portal chassis, fixed with respect to the basement 8. The grinding machine 1 further comprises a stringer 59, which is longitudinally extended along the station 14, and has a related guide 73 parallel to direction A, and supports the grinding head 77 configured to grind a side 78 of the edge 5 parallel to direction A.

The grinding head 77 further comprises a fork-shaped structure 80. The structure 80 comprises two mutually facing and parallel arms 81, and an intermediate cross member 82 connecting the arms 81, and the structure 80 is movably coupled to the stringer 59 through an assembly 84 for attaching and handling the structure 80. The assembly 84 is part of the grinding head 77 and comprises a trolley 85 slidingly coupled to the guide 73 for advancing the structure 80 along the side 78, and a fifth wheel 86 interposed between the trolley 85 and the cross member 82 and configured to allow the structure 80 to rotate with respect to the trolley 85 around a vertical axis 87 that is orthogonal to the guide 73. The trolley 85 and the fifth wheel 86 are actuated, by interposing a transmission (not shown), and housed in the stringer 59, from a motor assembly 88 supported, in particular, by the chassis 56 and driven by a driving and control unit 25' (schematically shown) of the grinding machine 1.

As can be further seen in FIG. 4 and FIG. 5, the structure 80 supports a plate 89, which is interposed between the arms 81, and is integrally connected to the free ends of the arms 81 themselves. The plate 89 comprises a portion 90 that supports, in turn, four spindles 91, 192, 93, 94 that are mutually placed side by side along a horizontal rectilinear direction B, orthogonal to the arms 81 and parallel to side 78 of slab 2 during grinding.

The spindles 91, 92, 93, 94 are able to rotate around respective axes 96, 97, 98, 99 orthogonal to direction B and projectingly carry respective ring-shaped grinding wheels 101, 102, 103, 104, which are integral and coaxial with the related spindles 91, 92, 93, 94. The grinding wheels 101 have annular axial grinding surfaces facing the side 78, and are preferably, housed in a guard (not shown). The axes 96, 97 are mutually parallel and lie on a plane parallel to slab 2, while axes 98, 99 are mutually skewed and form respective angles that are mutually equal and opposite with the plane where axes 96, 97 lie, so that each grinding wheel 103, 104 can bevel a related edge of side 78. In a preferred embodiment, at least one of the four axes 96, 97, 98 and 99 is parallel to at least one other of the four axes 96, 97, 98 and 99. In a preferred embodiment, at least one of the four axes 96, 97, 98 and 99 is not parallel to at least one other of the four axes 96, 97, 98 and 99.

In a preferred embodiment, the grinding wheels 101, 102, 103, 104 are arranged in such position and have such dimensions as to globally show an encumbrance L, measured in parallel with direction B, included between about 25 and 35 centimeters, and preferably equal to about 30 centimeters.

Referring again to FIG. 4 and FIG. 5, the grinding head 77 comprises, for each spindle 91, 92, 93, 94, a related motor 111, 112, 113, 114 coupled to the spindle 91, 92, 93, 94 by a transmission (not shown), such as for example a belt transmission, in order to rotate each grinding wheel 101, 102, 103, 104 around its related axis 96, 97, 98, 99 independently one from another. The grinding head 77 further comprises, for each spindle 91, 92, 93, 94, a related motor 121, 122, 123, 124 coupled with the spindle 91, 92, 93, 94 by a transmission (not shown), such as for example a toothed wheel transmission, in order to axially place each grinding wheel 101, 102, 103, 104 with respect to the side 78 independently one from another.

The motors 111, 112, 113, 114, 121, 122, 123, 124 are integrally connected with the plate 89, and positioned between the arms 81. In a preferred embodiment, the motors 111, 112, 113, 114, 121, 122, 123, 124 have respective elongated structures in orthogonal directions to direction B, to contain the encumbrance along direction B between the arms 81. The motors 121, 122 (partially shown in FIG. 5) and 124 are arranged on the opposite side of the related spindles 91, 92, 94 with respect to the cross member 82, while the motors 111, 112, 123, 113, 114 extend in parallel with the related axes 96, 97, 98, 99, in intermediate positions between portion 90 and cross member 82. In particular, the motors 111 and 112 projectingly extend from one portion 130 of the plate 89 and are aligned one with the other along their longitudinal axes.

In one embodiment, the present invention is provided a method of grinding the edges of a glass slab that reduces or eliminates positioning and squaring errors of the semi-finished glass slabs with respect to grinding wheels while the semi-finished glass slabs are moved on a conveyor. The method comprises providing a grinding machine according to the present invention.

During grinding, the glass slab 2 is transferred to the station 14, and is placed and blocked in the reference position in station 14. The motor assembly 88 is driven by the unit 25' to place the grinding head 77 in a working start position corresponding to a first vertex of the side 78. Then, using pre-set working parameters, the unit 25' drives the motors 121, 122, 123, 124 in order to bring the grinding wheels 101, 102, 103, 104 to the slab 2, and the assembly 88 and the motors 111, 112, 113, 114 in order to move the grinding head 77 along a path defined by the guide 73 and to grind the side 78, until the second vertex of the side 78 is reached. Once grinding is completed, the grinding wheels 101, 102, 103, 104 are axially moved back, the head 77 is taken back to the working start position and the slab 2 is moved away from the station 14, in order to grind the next glass slab.

As will be appreciated by one of ordinary skill in the art with reference to this disclosure, the grinding machine and the grinding head of the present invention reduce or eliminate positioning and squaring errors of the semi-finished glass slabs with respect to grinding wheels while the semi-finished glass slabs are moved on a conveyor and keep variability of successively ground slabs to a minimum. The grinding machine and the grinding head of the present invention accomplish this by keeping the glass slab in a fixed and univocal reference position by the assembly during grinding and polishing and, instead of two different working stations, the grinding and polishing operations are performed by the grinding head of the present invention that operates the grinding wheels on the fixed slab according to working programs that allow operating and moving the grinding wheels independently one from the other, as compared to currently used grinding machines where the slab is passed through a working station that has grinding wheels arranged in fixed positions.

Moreover, the head 77 is extremely compact due to the arrangement of spindles 91, 92, 93, 94 and the elongated shape of the engines, and has a relatively small size compared to prior art heads measured between the arms 81, allowing the head 77 to grind relatively small glass slabs 2.

Additionally, the spindles 91, 92, 93, 94 are actuated by axially advancing motors 121, 122, 123, 124 and rotating motors 111, 112, 113, 114 that are mutually independent, so that both the axial positioning and the cutting parameters of each of the grinding wheels 101, 102, 103, 104 can be accurately adjusted.

Finally, the fifth wheel 86 allows the grinding wheels 101, 102, 103, 104 to be moved away from the station 14 by rotating the structure 80 to perform maintenance and replacement operations on the grinding wheels themselves.

Although the present invention has been discussed in considerable detail with reference to certain preferred embodiments, other embodiments are possible. For example, the spindles and motors could be in a different number or arranged in different positions from those disclosed above. Additionally, the stated encumbrances could change when the number and sizes of the grinding wheels change. Finally, the grinding machine can comprise a plurality of grinding heads according to the present invention, where each grinding head is configured to grind a different size of glass slab. Therefore, the scope of the appended claims should not be limited to the description of preferred embodiments contained in this disclosure.

What is claimed is:

1. A grinding head for a grinding machine for grinding a glass slab having an edge and threads comprising:

a) at least one supporting structure;

b) two first grinding wheels for grinding the edge of the slab, the two first grinding wheels being supported and rotatingly driven by two respective first spindles, the two first grinding wheels and the two first spindles being contained in and supported by the supporting structure;

c) at least one second grinding wheel for grinding the threads of the slab, the second grinding wheel being supported and rotatingly driven by a second spindle, the second grinding wheel and the second spindle being contained in and supported by the supporting structure;

d) at least one third grinding wheel for polishing the edge of the slab, the third grinding wheel being supported and rotatingly driven by a third spindle, the third grinding wheel and the third spindle being contained in and supported by the supporting structure; and e) at least one fourth grinding wheel for polishing the threads of the slabs, the fourth grinding wheel being supported and rotatingly driven by a fourth spindle, the fourth grinding wheel and the fourth spindle being contained in and supported by the supporting structure;

where the first and third grinding wheels for grinding and polishing the edges rotate, independently one from another, around an axis that is perpendicular to a rotation axis of the second and fourth grinding wheels for grinding and polishing the threads;

where the first, second, third and fourth grinding wheels for grinding and polishing the edge and grinding and polishing the threads are configured to perform, during operation, axial movements along the slabs; and where the axial movements of the first, second, third and fourth grinding wheels are independently actuated one from another.

2. A grinding machine for grinding a glass slab comprising a grinding head according to claim 1, and further comprising a chassis for supporting the grinding head.

3. The grinding machine of claim 2, where the grinding head comprises four spindles that rotate around four respective axes, and configured to carry respective grinding wheels for grinding or polishing a section of the edge of the glass slab;

where the grinding machine comprises means for connecting the spindles to the chassis; and where the means for connecting comprises a supporting structure for the spindles and attaching and handling means carried by the supporting structure for coupling the supporting structure to the chassis in a movable way at least in a first advancement direction and configured to be motored in order to displace, during operation, the supporting structure with respect to the chassis along the section to be ground in first advancement direction.

4. The grinding machine of claim 3, where the attaching and handling means comprises a slide configured to cooperate with a guide carried by the chassis.

5. The grinding machine of claim 4, where the attaching and handling means comprises a fifth wheel interposed between the supporting structure and the slide to allow a rotation of the supporting structure with respect to the slide around a hinge axis.

6. The grinding machine of claim 5, where the fifth wheel axis is orthogonal to the first advancement direction.

7. The grinding machine of claim 3, where at least one of the four axes is parallel to at least one other of the four axes.

8. The grinding machine of claim 3, where at least one of the four axes is not parallel to at least one other of the four axes.

9. The grinding machine of claim 3, further comprising a motor for each spindle for rotating the grinding wheel related to each spindle.

10. The grinding machine of claim 3, further comprising a motor for each spindle for axially advancing the grinding wheel related to each spindle.

11. The grinding machine of claim 3, where the axes are orthogonal to a rectilinear direction that is parallel, during operation, to the section to be ground, an encumbrance occupied by the grinding wheels, measured along a rectilinear direction, being included between 25 and 35 centimeters.

12. The grinding machine of claim 9, where at least part of the motors have respective elongated structures in orthogonal directions to a rectilinear direction.

13. The grinding machine of claim 3, where the grinding head comprises two first spindles that are able to rotate around respective mutually parallel first axes lying in a plane, and two second spindles that form respective angles that are mutually equal and opposite with the plane.

14. The grinding machine of claim 3, where the supporting structure is fork-shaped.

15. The grinding head of claim 1, where the supporting structure is further equipped with means for supporting the glass slab, and where the means for supporting comprises a plurality of wheels to facilitate moving the slab.

16. The grinding head of claim 1, where the grinding wheel for grinding and polishing the threads and the grinding wheel for polishing the edge are driven by their respective spindles to create constant pressure by the grinding wheels on the glass slab during operation and to compensate for the consumption of the grinding wheels during their operation.

17. The grinding head of claim 16, where the spindles each comprise resilient means pre-loaded by a stepped motor that drives a ball screw for realizing the constant pressure on the glass slab during operation.

18. The grinding head of claim 16, where each of the spindles further comprises braking means that operates on sliding guides and block an advancement of the grinding wheels against the glass slabs between one slab and a following slab, to prevent the grinding wheels from penetrating into a hollow space between the two successive glass slabs during operation.

19. A grinding machine for grinding a glass slab comprising a grinding head comprising:

a) a chassis for supporting the grinding head; and b) a grinding head for a grinding machine for grinding a glass slab having an edge and threads comprising:

i) at least one supporting structure;

ii) at least one first grinding wheel for grinding the edge of the slab, the first grinding wheel being supported and rotatingly driven by a first spindle, the first grinding wheel and the first spindle being contained in and supported by the supporting structure;

iii) at least one second grinding wheel for grinding the threads of the slab, the second grinding wheel being supported and rotatingly driven by a second spindle, the second grinding wheel and the second spindle being contained in and supported by the supporting structure;

iii) at least one third grinding wheel for polishing the edge of the slab, the third grinding wheel being supported and rotatingly driven by a third spindle, the third grinding wheel and the third spindle being contained in and supported by the supporting structure; and iv) at least one fourth grinding wheel for polishing the threads of the slabs, the fourth grinding wheel being supported and rotatingly driven by a fourth spindle, the fourth grinding wheel and the fourth spindle being contained in and supported by the supporting structure;

where the first and third grinding wheels for grinding and polishing the edges rotate, independently one from another, around an axis that is perpendicular to a rotation axis of the second and fourth grinding wheels for grinding and polishing the threads;

where the first, second, third and fourth grinding wheels for grinding and polishing the edge and grinding and polishing the threads are configured to perform, during operation, axial movements along the slabs;

where the axial movements of the first, second, third and fourth grinding wheels are independently actuated one from another;

where the grinding head comprises four spindles that rotate around four respective axes, and configured to cany respective grinding wheels for grinding or polishing a section of the edge of the glass slab;

where the grinding machine comprises means for connecting the spindles to the chassis;

where the means for connecting comprises a supporting structure for the spindles and attaching and handling means carried by the supporting structure for coupling the supporting structure to the chassis in a movable way at least in a first advancement direction and configured to be motored in order to displace, during operation, the supporting structure with respect to the chassis along the section to be ground in first advancement direction;

where the attaching and handling means comprises a slide configured to cooperate with a guide canied by the chassis; and where the attaching and handling means comprises a fifth wheel interposed between the supporting structure and the slide to allow a rotation of the supporting structure with respect to the slide around a hinge axis.

20. The grinding machine of claim 19, where the grinding head further comprises two first grinding wheels that are rotatingly driven by two respective first spindles.

21. The grinding machine of claim 19, where the fifth wheel axis is orthogonal to the first advancement direction.

22. The grinding machine of claim 19, where at least one of the four axes is parallel to at least one other of the four axes.

23. The grinding machine of claim 19, where at least one of the four axes is not parallel to at least one other of the four axes.

24. The grinding machine of claim 19, further comprising a motor for each spindle for rotating the grinding wheel related to each spindle.

25. The grinding machine of claim 19, further comprising a motor for each spindle for axially advancing the grinding wheel related to each spindle.

26. The grinding machine of claim 19, where the axes are orthogonal to a rectilinear direction that is parallel, during operation, to the section to be ground, an encumbrance occupied by the grinding wheels, measured along a rectilinear direction, being included between 25 and 35 centimeters.

27. The grinding machine of claim 24, where at least part of the motors have respective elongated structures in orthogonal directions to a rectilinear direction.

28. The grinding machine of claim 19, where the grinding head comprises two first spindles that are able to rotate around respective mutually parallel first axes lying and a plane, and two second spindles that form respective angles that are mutually equal and opposite with the plane.

29. The grinding machine of claim 19, where the supporting structure is fork-shaped.

30. The grinding machine of claim 19, where the supporting structure is further equipped with means for supporting the glass slab, and where the means for supporting comprises a plurality of wheels to facilitate moving the slab.

31. The grinding machine of claim 19, where the grinding wheel for grinding and polishing the threads and the grinding wheel for polishing the edge are driven by their respective spindles to create constant pressure by the grinding wheels on the glass slab during operation and to compensate for the consumption of the grinding wheels during their operation.

32. The grinding machine of claim 31, where the spindles each comprise resilient means pre-loaded by a stepped motor that drives a ball screw for realizing the constant pressure on the glass slab during operation.

33. The grinding machine of claim 31, where each of the spindles further comprises braking means that operates on sliding guides and block an advancement of the grinding wheels against the glass slabs between one slab and a following slab, to prevent the grinding wheels from penetrating into a hollow space between the two successive glass slabs during operation.

34. A method of grinding the edges of a glass slab that reduces or eliminates positioning and squaring enors of semi-finished glass slabs with respect to grinding wheels while the semi-finished glass slabs are moved on a conveyor, comprising:

a) providing a grinding machine according to claim 19; and b) grinding the edges of the glass slab using the grinding machine.

* * * * *

UNITED STATES PATENT AND TRADEMARK OFFICE

CERTIFICATE OF CORRECTION

PATENT NO. : 7,134,936 B2
APPLICATION NO. : 10/820201
DATED : November 14, 2006
INVENTOR(S) : Davide Gariglio It is certified that error appears in the above-identified patent and that said Letters Patent is hereby corrected as shown below:

Claim 19, column 10, line 44, replace “cany” with --carry--.

Claim 19, column 10, line 57, replace “canied” with --carried--.

Claim 34, column 12, line 20, replace “enors” with --errors--.

Signed and Sealed this

Ninth Day of January, 2007

JON W. DUDAS
*Director of the United States Patent and Trademark Office*